US009353428B2

(12) United States Patent
Peker et al.

(10) Patent No.: US 9,353,428 B2
(45) Date of Patent: May 31, 2016

(54) ZIRCONIUM BASED BULK METALLIC GLASSES WITH HAFNIUM

(71) Applicants: Atakan Peker, Spokane, WA (US); Dongchun Qiao, Spokane, WA (US)

(72) Inventors: Atakan Peker, Spokane, WA (US); Dongchun Qiao, Spokane, WA (US)

(73) Assignee: Washington State University, Pullman, WA (US)

( * ) Notice: Subject to any disclaimer, the term of this patent is extended or adjusted under 35 U.S.C. 154(b) by 540 days.

(21) Appl. No.: 13/847,773

(22) Filed: Mar. 20, 2013

(65) Prior Publication Data

US 2015/0307975 A1 Oct. 29, 2015

Related U.S. Application Data

(60) Provisional application No. 61/617,212, filed on Mar. 29, 2012.

(51) Int. Cl.

| | |
|---|---|
| ***C22C 45/10*** | (2006.01) |
| ***C22C 16/00*** | (2006.01) |
| ***C22C 30/02*** | (2006.01) |

(52) U.S. Cl.

CPC ..... *C22C 45/10* (2013.01); *C22C 16/00* (2013.01); *C22C 30/02* (2013.01)

(58) Field of Classification Search

None

See application file for complete search history.

(56) References Cited

U.S. PATENT DOCUMENTS

| | | | | |
|---|---|---|---|---|
| 5,032,196 | A | 7/1991 | Masumoto et al. | |
| 5,288,344 | A | 2/1994 | Peker et al. | |
| 5,618,359 | A | 4/1997 | Lin et al. | |
| 5,735,975 | A | 4/1998 | Lin et al. | |
| 6,521,058 | B1 | 2/2003 | Inoue et al. | |
| 6,652,673 | B1 | 11/2003 | Inoue et al. | |
| 6,682,611 | B2 | 1/2004 | Zhang et al. | |
| 6,709,536 | B1 | 3/2004 | Kim et al. | |
| 6,805,758 | B2 | 10/2004 | Wolter | |
| 7,008,490 | B2 | 3/2006 | Peker | |
| 7,147,727 | B2 | 12/2006 | Kim et al. | |
| 7,368,023 | B2 | 5/2008 | Chang et al. | |
| 2012/0073707 | A1 | 3/2012 | Gong et al. | |
| 2012/0298264 | A1 | 11/2012 | Yi et al. | |
| 2013/0032252 | A1 | 2/2013 | He et al. | |
| 2013/0105300 | A1 * | 5/2013 | Jang | C22C 45/10 204/192.15 |

OTHER PUBLICATIONS

Notice of Allowance issued in U.S. Appl. No. 13/847,559 on Jan. 11, 2016, 7 pages.

Office Action issued in U.S. Appl. No. 13/847,759 on Sep. 29, 2015, 8 pages.

* cited by examiner

*Primary Examiner* — George Wyszomierski

(74) *Attorney, Agent, or Firm* — Liang IP, PLLC

(57) ABSTRACT

Various embodiments of zirconium based bulk metallic glass with hafnium are described herein. In one embodiment, an alloy composition includes zirconium (Zr), hafnium (Hf), copper (Cu), aluminum (Al), at least one element from a group consisting of niobium (Nb) and titanium (Ti), and at least one element from a group consisting of nickel (Ni), iron (Fe), and cobalt (Co).

19 Claims, No Drawings

ZIRCONIUM BASED BULK METALLIC GLASSES WITH HAFNIUM

CROSS-REFERENCE TO RELATED APPLICATION(S)

This application claims priority to U.S. Provisional Patent Application No. 61/617,212, filed on Mar. 29, 2012.

STATEMENT REGARDING FEDERALLY-SPONSORED RESEARCH

This work was made with support provided by the U.S. Department of Defense, through Office of Naval Research, grant number N00014-06-1-0315. The U.S. government has certain rights in the invention.

BACKGROUND

Metallic glasses are metallic alloys that have a glassy phase with an amorphous atomic structure in a solid state. The glassy phase is believed to be a metastable phase and not a thermodynamically stable phase in a solid state. As a result, metallic glasses are typically formed by quenching from a liquid state to reduce or even avoid nucleation and growth of crystalline phases during solidification. As a result, casting large articles of metallic glasses may be difficult because large articles may not be quenched at sufficiently high rates.

DETAILED DESCRIPTION

Various embodiments of zirconium based (Zr-based) bulk metallic glass(es) ("BMG") with hafnium addition, methods of manufacturing such metallic glasses, and articles formed from such BMG are described below. Certain example compositions, methods, and articles of manufacture are described below with particular components and operations for illustration purposes only. Other embodiments in accordance with the present technology may also include other suitable components and/or may operate at other suitable conditions. A person skilled in the relevant art will also understand that the technology may have additional embodiments, and that the technology may be practiced without several of the details of the embodiments described below.

Overview

As discussed above, casting large articles of metallic glasses may be difficult because large articles may not be quenched at sufficiently high cooling rates. A characteristic value of metallic glasses is a "critical cooling rate" of a metallic alloy to form an amorphous (or glassy) phase. The critical cooling rate is a minimum cooling rate required to avoid significant nucleation and growth of one or more crystalline phases during solidification. As such, a critical cooling rate is considered as a measure of glass forming ability of an alloy. Thus, a lower critical cooling rate indicating a higher glass forming ability of an alloy.

A "critical cooling rate" can also be related to a "critical casting thickness," which may be defined as the upper bound value for the smallest section thickness of a cast article that can be formed into an amorphous phase. For example, for long cylindrical rod castings, a critical casting thickness may be the largest rod diameter that can be cast into an amorphous phase. When critical cooling rates are less than about 1,000 K/sec, corresponding glass forming alloys may have sufficiently high critical casting thicknesses that such alloys may be referred to as "bulk metallic glasses" suitable for casting into three-dimensional metallic glass objects.

Zr-based BMG can have high strengths, high corrosion resistance and large elastic strain limits. Thus, such materials have become attractive to various engineering applications, such as golf-club heads, medical devices and implants, and casings for mobile electronic devices (e.g. smartphones). However, critical casting thicknesses of such zirconium based bulk metallic glasses can decrease substantially under various processing conditions. For example, the level of impurities (e.g. oxygen) accumulated either from raw materials or processing environment can adversely affect the critical cooling rate.

Several embodiments of the present technology are directed to alloys of Zr-based BMG with low critical cooling rates. For the purposes of this disclosure, unless otherwise noted, a metallic glass object is defined as having about 70% to about 100% amorphous phase by volume. For example, a metallic glass object can have about 95% amorphous phase by volume. Alloys and/or alloy formulations, unless otherwise noted, are described in atomic percentages, and ratios are based on atomic percentages.

As used herein, a Zr-based alloy is defined as a metallic alloy with zirconium (Zr) content of about 25 to about 70 atomic percent. Bulk metallic glass is defined as an alloy of metallic glass that can be cast into a metallic glass object above a threshold size. For example, a metallic glass object can be a cylindrical rod with a diameter of about 5 mm or more. Such metallic glass objects can be produced by metallic mold casting, in which a BMG alloy in a molten state is injected into a metallic mold (e.g. copper or steel), or can be produced by other processes and casting methods. The metallic glass objects can also be produced with reinforcement materials, such as refractory metals (e.g. Ta, W, Nb, etc.) and ceramics (e.g. SiC), to form objects of hybrid and/or composite materials. The reinforcements can be in various shapes and forms such as wires and particulates.

The inventors have surprising recognized that glass forming abilities of Zr-based metallic glasses can be increased when a select amount of Hf is substituted for Zr. For example, a Zr-based metallic glass which can previously be cast only into about 10 mm diameter of metallic glass object, can now be cast into about 12 mm or about 14 mm diameter metallic glass object with a partial substitution of Hf for Zr. Alternatively, a Zr-based metallic glass which is not a bulk metallic glass, can become a bulk metallic glass with a partial substitution of Hf for Zr.

As described in more detail below, in certain embodiments, the present technology is directed to alloys and/or alloy formulations of Zr-based metallic glasses comprising hafnium (Hf), to methods of making such alloys, and to articles cast from such alloys. In one embodiment, a Zr-based metallic glass can comprise Zr of about 25 to about 70 atomic percent and Hf in the range of from about 5 to about 25 atomic percent. In another embodiment, a Zr-based metallic glass can comprise Zr of about 40 to about 65 atomic percent and Hf in the range of from 8 to 16 atomic percent. In yet another embodiment, a Zr-based metallic glass can comprise Zr, Hf, and two or more elements from the group of (Cu, Ni, Fe, Co, Nb, Ti, Be and Al). In a further embodiment, a Zr-based metallic glass can comprise Zr, Hf, Cu, Al, at least one element from the group of (Ni, Fe, Co), and at least another element from the group of (Nb and Ti). In yet a further embodiment, a Zr-based metallic glass can comprise Hf and one or more of (Ti and Nb). A ratio of Hf/(Ti+Nb) can be in the range of from about 2 to about 5 or from about 3 to about 4. In another embodiments, a Zr-based metallic glass can comprise Hf and Nb. A ratio of Hf/Nb can be in the range of from about 2 to about 5 or from about 3 to about 4.

In other embodiments, the present technology is directed to methods of making Zr-based BMG with Hafnium. In one embodiment, a method can include a partial substitution of Hf for Zr in a Zr-based metallic glass. The resulting Zr-based metallic glass can comprise Hf in the range of from about 8 to about 16 atomic percent. In another embodiment, the method can include adding Hf and one or more of (Ti and Nb) into a Zr-based metallic glass. The resulting Zr-based metallic glass can comprise Hf in the range of from about 8 to about 16 atomic percent and the ratio of Hf/(Ti+Nb) is in the range of from about 3 to about 4.

In further embodiments, the present technology is directed to articles cast from a Zr-based metallic glass in which an amorphous phase of the cast article has an elastic strain limit of about 1.5% or more. In another embodiment, the cast article has a section thickness of at least about 2.0 mm, and the amorphous phase of this cast article has a bend ductility of about 4% at section thickness about 2.0 mm. In still another embodiment, the Zr-based metallic glass can comprise Hf and has a density value within about 10% of about 7.8 g/cc, or within about 5% of about 7.8 g/cc. In still another embodiment, the Zr-based metallic glass can comprise Hf and has a density value from about 7.7 g/cc to about 8.0 g/cc.

Alloy Compositions

Several embodiments of the present technology are directed to alloys that comprise Zr, Hf, and two or more elements from the group of (Cu, Ni, Fe, Co, Nb, Ti, and Al). A variety of additional elements may be added, or substituted, into the latter group of elements. Such additional elements can include Ta, Mo, Y, V, Cr, Sc, Be, Si, B, Zn, Pd, Ag, and Sn. Some of these elements can be added in substantial amounts. For example, Be may be added up to about 30 atomic percent and may substitute one or more of (Cu, Ni, and Al). Elements such as Si and B, may be added at modest amounts, for example, at about 3 atomic percent or less.

In one embodiment, the alloys can be quaternary (four components) alloy systems, in which components of the alloys are about 5 atomic percent or more. In another embodiment, the alloys can be quinary (five components) alloy systems, in which each of at least three components is about 5 atomic percent or more. In further embodiments, the alloys can be six component or higher order alloy systems, in which each of at least four components is about 5 atomic percent or more.

The alloys may have bend ductility of about 4% at a section thickness of about 2 mm to about 10 mm. An amorphous phase of an example cast article has a bend ductility of about 4% with the smallest section thickness being about 4 mm. In contrast, conventional Zr-based BMG have negligible or no bend ductility with the smallest section thickness being about 2 mm.

In certain embodiments, alloys of the present technology can be described by the following formula:

$$Zr_aHf_b(Nb,Ti)_cCu_d(Ni,Fe,Co)_eAl_fPPP_gQQQ_hRRR_i$$

In the above formula, and in other formulas herein, the parentheses indicate that the alloy may include at least one element from the elements within the corresponding parentheses. For example, an alloy according to the foregoing formula may include Nb, Ti, or a combination of Nb and Ti. Also, PPP denotes elements (e.g. Ta, V, Be, Pd, Ag), which generally does not alter the glass forming ability of the base alloy. Pd and Ag may slightly improve the glass forming ability, while Be may improve the glass forming significantly in other select cases. QQQ denotes elements (e.g. Y, Si, Sc), which may improve the bulk glass forming ability of the base alloy when added in small amounts by, for example, remedying the negative effect of oxides in the alloy. RRR denotes any other element, which is typically not essential for the purposes of bulk glass forming ability when added in small amounts.

In several embodiments, a can be in the range of from about 25 to about 65, b can be in the range of from about 5 to about 25, c can be in the range of from about 0 to about 10, d can be in the range of from about 0 to about 50, e can be in the range of from about 0 to about 35, f can be in the range of from about 0 to about 30, g can be in the range of from about 0 to about 15, h can be in the range of from about 0 to about 5 and i can be in the range of from about 0 to about 5.

In other embodiments, a can be in the range of from about 30 to about 60, b can be in the range of from about 8 to about 20, c can be in the range of from about 0 to about 8, d can be in the range of from about 0 to about 40, e can be in the range of from about 0 to about 30, f can be in the range of from about 5 to about 20, g can be in the range of from about 0 to about 10, h can be in the range of from about 0 to about 2 and i can be in the range of from about 0 to about 2.

In further embodiments, a can be in the range of from about 35 to about 55, b can be in the range of from about 8 to about 16, c can be in the range of from about 0 to about 6, d can be in the range of from about 0 to about 40, e can be in the range of from about 0 to about 20, f can be in the range of from about 7 to about 15, g can be in the range of from about 0 to about 5, h can be in the range of from about 0 to about 1 and i can be in the range of from about 0 to about 1.

In yet further embodiments, a can be in the range of from about 40 to about 55, b can be in the range of from about 8 to about 14, c can be in the range of from about 2 to about 5, d can be in the range of from about 0 to about 35, e can be in the range of from about 0 to about 20, f can be in the range of from about 8 to about 11, g can be less than about 5, and both h and i can be about 0.

In additional embodiments, a+b can be in the range of from about 35 to about 70, d+e can be in the range of from about 10 to about 50, and, g+h+i can be in the range of from about 0 to about 10. In yet other embodiments, a+b+c can be in the range of from about 45 to about 70, d+e can be in the range of from about 20 to about 45, and, g+h+i can be in the range of from about 0 to about 5.

In certain embodiments, alloys of the present technology can be described by the following generic formula:

$$Zr_aHf_b(Nb,Ti)_cCu_d(Ni,Fe,Co)_eAl_fPPP_gQQQ_h$$

In several embodiments, a can be in the range of from about 30 to about 65, b can be in the range of from about 8 to about 20, c can be in the range of from about 0 to about 8, d can be in the range of from about 0 to about 40, e can be in the range of from about 0 to about 30, f can be in the range of from about 5 to about 25, g can be in the range of from about 0 to about 10, and h can be in the range of from about 0 to about 2.

In other embodiments, a can be in the range of from about 35 to about 60, b can be in the range of from about 8 to about 16, c can be in the range of from about 0 to about 6, d can be in the range of from about 0 to about 40, e can be in the range of from about 0 to about 20, f can be in the range of from about 7 to about 15, g can be in the range of from about 0 to about 5, and h can be in the range of from about 0 to about 1.

In further embodiments, a can be in the range of from about 40 to about 55, b can be in the range of from about 8 to about 14, c can be in the range of from about 2 to about 5, d can be in the range of from about 0 to about 35, e can be in the range of from about 0 to about 20, f can be in the range of from about 8 to about 11, g can be less than about 5, and h can be about 0.

In yet further embodiments, a+b can be in the range of from about 45 to about 70, d+e can be in the range of from about 10 to about 50, and, g+h can be in the range of from about 0 to about 5. In other embodiments, a+b+c can be in the range of from about 45 to about 70, d+e can be in the range of from about 20 to about 45, and, g+h can be in the range of from about 0 to about 2.

In yet other embodiments, alloys of the present technology can be described by the following generic formula:

$$Zr_aHf_b(Nb,Ti)_cCu_d(Ni,Fe,Co)_eAl_f$$

In several embodiments, a can be in the range of from about 35 to about 60, b can be in the range of from about 8 to about 20, c can be in the range of from about 0 to about 8, d can be in the range of from about 0 to about 40, e can be in the range of from about 0 to about 30, and f can be in the range of from about 5 to about 25.

In other embodiments, a can be in the range of from about 40 to about 60, b can be in the range of from about 8 to about 16, c can be in the range of from about 0 to about 6, d can be in the range of from about 0 to about 40, e can be in the range of from about 0 to about 20, and f can be in the range of from about 7 to about 15.

In yet other embodiments, a can be in the range of from about 45 to about 55, b can be in the range of from about 8 to about 14, c can be in the range of from about 2 to about 5, d can be in the range of from about 0 to about 35, e can be in the range of from about 0 to about 20, and f can be in the range of from about 8 to about 11.

In further embodiments, a+b can be in the range of from about 40 to about 70, and d+e can be in the range of from about 10 to about 50. In yet further embodiments, a+b+c can be in the range of from about 55 to about 70 and d+e can be in the range of from about 20 to about 40.

Certain embodiments of the alloys described above can form Zr-based BMG having a density value in the range of from about 7.0 to about 8.5 g/cc. Other embodiments of the alloys can form Zr-based BMG having a density value in the range of from about 7.4 to about 8.1 g/cc. Yet other embodiments of the alloys can form Zr-based BMG with substantially no Ni content. Further embodiments of the alloys can form Zr-based BMG with substantially no Ni or Co content.

Cast Articles

Embodiments of alloys described above can have engineering properties such as high strengths and high elastic strain limits. The Zr-based BMG of the present technology can have high yield strength exceeding 1.4 GPa, and elastic strain limits of 1.8% or higher. In one embodiment, the formulations of the Zr-based BMG can be adjusted to have still higher yield strength exceeding 1.6 GPa, such as by reducing Zr relative to a total concentration of (Cu, Ni, Fe, Co).

In certain embodiments, a cast article of Zr-based BMG can have a section thickness of about 5 mm to about 30 mm (e.g., about 5 mm, about 10 mm, about 20 mm or about 30 mm). For example, the cast article can have a section thickness of about 5 mm and a density value in the range of from about 7.0 to about 8.5 g/cc. In another example, the cast article can have a section thickness of about 10 mm and a density value in the range of from about 7.4 to about 8.1 g/cc. In other embodiments, a cast article of Zr-based BMG can have a bend ductility of about 4% with the smallest section thickness being about 2 mm, of about 4% with the smallest section thickness being about 4 mm, or about 8% with the smallest section thickness being about 2 mm. In other embodiments, a cast article of Zr-based BMG can have a minimum section thickness of about 5 mm to about 15 mm (e.g., about 5 mm, about 10 mm, or about 15 mm).

Methods of Making

Additional aspects of the present technology are directed to methods of making cast articles from alloys of zirconium-based bulk metallic glass. In one embodiment, the method includes partially substituting Zr with Hf such that the resulting Zr-based bulk metallic glass comprises Hf in the range of from about 8 to about 16 atomic percent. In another embodiment, the method can also include adding or adjusting Nb content in the alloy such that the ratio of Hf/Nb is in the range of from about 2 to about 5.

In yet another embodiment, a method of making cast articles of Zr-based bulk metallic glass includes providing a formulation of Zr-based bulk metallic glass comprising Hf and Cu. The Hf is in the range of from about 8 to about 16 atomic percent. The method also includes forming a first master alloy by fusing the metallic Hf and Cu constituents, and forming a second master alloy by fusing the first Hf—Cu master alloy with other metallic constituents. The method further includes re-melting the second master alloy and cooling in a metallic mold sufficiently fast to cast a metallic glass object having at least 70% amorphous phase by volume.

In a further embodiment, a method of making cast articles of Zr-based bulk metallic glass includes providing a formulation of Zr-based bulk metallic glass comprising Hf, Cu, Nb, and Ni. The Hf is in the range of from about 8 to about 16 atomic percent, and a ratio of Hf/Nb is in the range of from about 2 to about 5. The method then includes forming a first master alloy by fusing the Hf and Cu constituents and forming a second master alloy by fusing the metallic Nb and Ni constituents. The method also includes forming a final master alloy by fusing Hf—Cu and Ni—Nb master alloys with other metallic constituents and re-melting the final master alloy and cooling in a metallic mold sufficiently fast enough to cast a metallic glass object having at least 95% amorphous phase by volume.

Examples

Alloys in accordance with several embodiments of the present technology were formed and tested for susceptibility to brittleness, as described below.

$$Zr_{45}Hf_{12}Nb_5Cu_{15.4}Ni_{12.6}Al_{10}$$

A 30 gram master alloy button of $Zr_{45}Hf_{12}Nb_5Cu_{15.4}Ni_{12.6}Al_{10}$ was prepared using a laboratory arc-melter. The resulting master alloy button exhibited a mirror-like luster and surface smoothness indicating amorphous phase formation. The master alloy button of $Zr_{57}Nb_5Cu_{15.4}Ni_{12.6}Al_{10}$ exhibited a level of sink and surface roughness, indicating crystallization much more than that of $Zr_{45}Hf_{12}Nb_5Cu_{15.4}Ni_{12.6}Al_{10}$, as confirmed by both optical microscopy and X-ray diffraction. A 16 mm diameter cylindrical rod of $Zr_{45}Hf_{12}Nb_5Cu_{15.4}Ni_{12.6}Al_{10}$ was prepared and yielded a fully amorphous sample, as confirmed by both optical microscopy and X-ray diffraction. A 14 mm diameter cylindrical rod of $Zr_{57}Nb_5Cu_{15.4}Ni_{12.6}Al_{10}$ was prepared under the same conditions and exhibited significant crystalline phases. Accordingly, an improvement was achieved by substitution of Zr by Hf.

$Zr_{50}Hf_{10}Nb_3Cu_{22}Fe_5Al_{10}$

A 20 g master alloy button of $Zr_{50}Hf_{10}Nb_3Cu_{22}Fe_5Al_{10}$ was prepared using a laboratory arc-melter. The resulting master alloy button exhibited a mirror-like luster and surface smoothness indicating amorphous phase formation. A 14 mm diameter cylindrical rod of $Zr_{45}Hf_{12}Nb_5Cu_{15.4}Ni_{12.6}Al_{10}$ was prepared and yielded a fully amorphous sample, as confirmed by both optical microscopy and X-ray diffraction. Samples of $Zr_{63}Cu_{22}Fe_5Al_{10}$ prepared under the same conditions exhibited significant crystalline phases, as confirmed by both optical microscopy and X-ray diffraction. Accordingly, an improvement was achieved by substitution of Zr by Hf.

From the foregoing, it will be appreciated that specific embodiments of the disclosure have been described herein for purposes of illustration, but that various modifications may be made without deviating from the disclosure. In addition, many of the elements of one embodiment may be combined with other embodiments in addition to or in lieu of the elements of the other embodiments. Accordingly, the technology is not limited except as by the appended claims.

We claim:

1. A metallic glass composition comprising zirconium (Zr), hafnium (Hf), copper (Cu), aluminum (Al), at least one element from a group consisting of niobium (Nb) and titanium (Ti), and iron (Fe), wherein a concentration of the zirconium is from about 25 to about 65 atomic percent, and wherein a concentration of the hafnium is from about 5 to about 25 atomic percent, and wherein the metallic glass composition substantially does not include nickel (Ni).

2. The metallic glass composition of claim 1 wherein the metallic glass composition has a formula of $Zr_aHf_b(Nb,Ti)_c$ $Cud(Fe)_eAl_f$, and wherein, a is from about 35 to about 60;
b is from about 8 to about 20;
c is from about 0 to about 8;
d is from about 0 to about 40;
e is from about 0 to about 30; and
f is from about 5 to about 25.

3. The metallic glass composition of claim 1 wherein the metallic glass composition has a formula of $Zr_aHf_b(Nb,Ti)_c$ $Cud(Fe)_eAl_f$, and wherein, a is from about 40 to about 60;
b is from about 8 to about 16;
c is from about 0 to about 6;
d is from about 0 to about 40;
e is from about 0 to about 20; and
f is from about 7 to about 15.

4. The metallic glass composition of claim 1 wherein the metallic glass composition has a formula of $Zr_aHf_b(Nb,Ti)_c$ $Cud(Fe)_eAl_f$, and wherein, a is from about 45 to about 55;
b is from about 8 to about 14;
c is from about 2 to about 5;
d is from about 0 to about 35;
e is from about 0 to about 20; and
f is from about 8 to about 11.

5. The metallic glass composition of claim 1 wherein the metallic glass composition has a formula of $Zr_aHf_b(Nb,Ti)_c$ $Cud(Fee)_eAl_f$, and wherein, a+b is from about 40 to about 55; and
d+e is from about 20 to about 50.

6. The metallic glass composition of claim 1 wherein the metallic glass composition has a formula of $Zr_aHf_b(Nb,Ti)_c$ $Cud(Fe)_eAl_f$, and wherein, a+b is from about 55 to about 70; and
d+e is from about 10 to about 40.

7. The metallic glass composition of claim 1 wherein the metallic glass composition has a formula of $Zr_{50}Hf_{10}Nb_3Cu_{22}Fe_5Al_{10}$.

8. The metallic glass composition of claim 1 wherein the metallic glass composition further includes at least one of tantalum (Ta), vanadium (V), beryllium (Be), palladium (Pd), or silver (Ag), and at least one of yttrium (Y), silicon (Si), or scandium (Sc).

9. An article formed from a metallic glass composition comprising zirconium (Zr) and hafnium (Hf), wherein a concentration of the zirconium is from about 25 to about 65 atomic percent, and wherein a concentration of the hafnium is from about 5 to about 25 atomic percent, and further wherein the metallic glass composition substantially does not include nickel (Ni).

10. The article of claim 9 wherein the metallic glass composition further includes copper (Cu), aluminum (Al), iron (Fe), and at least one element from a group consisting of niobium (Nb) and titanium (Ti).

11. The article of claim 10 wherein a ratio of Hf/(Ti+Nb) is in the range of from about 2 to about 5.

12. The article of claim 10 wherein the metallic glass composition substantially does not include Ni or Co.

13. The article of claim 10 wherein a density of the article is about 7.0 to about 8.5 grams per center meter cubed.

14. The article of claim 10 wherein a yield strength of the article is about 1.4 GPa to about 2.2 GPa.

15. The article of claim 10 wherein section thickness of the article is about 5 mm to about 30 mm.

16. The article of claim 10 wherein a bend ductility of the article is about 4% with a smallest section thickness being about 2 mm.

17. A metallic glass composition, comprising:

zirconium (Zr);
hafnium (Hf);
copper (Cu);
aluminum (Al);
at least one element from a group consisting of niobium (Nb) and titanium (Ti);
iron (Fe);
at least one element from a group consisting of tantalum (Ta), vanadium (V), beryllium (Be), palladium (Pd), and silver (Ag);
at least one element from a group consisting of yttrium (Y), silicon (Si), and scandium (Sc); and
wherein a concentration of the zirconium is from about 25 to about 65 atomic percent, and wherein a concentration of the hafnium is from about 5 to about 25 atomic percent, and wherein the metallic glass composition substantially does not include nickel (Ni) or cobalt (Co).

18. The metallic glass composition of claim 17 wherein the metallic glass composition has a formula of $Zr_aHf_b(Nb,Ti)_c$ $Cu_d(Fe)_eAl_fPPP_gQQQ_h$ where PPP is the at least one element from a group consisting of tantalum (Ta), vanadium (V), beryllium (Be), palladium (Pd), and silver (Ag) and QQQ is the at least one element from a group consisting of yttrium (Y), silicon (Si), and scandium (Sc), and wherein a+b is about 45 to about 70;
d+e is about 10 to about 50; and
g+h is about 0 to about 5.

19. The metallic glass composition of claim 17 wherein the metallic glass composition has a formula of $Zr_aHf_b(Nb,Ti)_c$ $Cu_d(Fe)_eAl_fPPP_gQQQ_h$ where PPP is the at least one element from a group consisting of tantalum (Ta), vanadium (V), beryllium (Be), palladium (Pd), and silver (Ag) and QQQ is the at least one element from a group consisting of yttrium (Y), silicon (Si), and scandium (Sc), and wherein a+b+c is about 45 to about 70;
d+e is about 20 to about 45; and
g+h is about 0 to about 2.

* * * * *